United States Patent [19]

Nakata et al.

[11] Patent Number: 4,855,708

[45] Date of Patent: Aug. 8, 1989

[54] VOLTAGE NON-LINEAR RESISTOR

[75] Inventors: Masami Nakata, Chita; Osamu Imai, Kasugai, both of Japan

[73] Assignee: NGK Insulators, Ltd., Nagoya, Japan

[21] Appl. No.: 219,382

[22] Filed: Jul. 15, 1988

[30] Foreign Application Priority Data

Aug. 21, 1987 [JP] Japan ..... 62-206579

[51] Int. Cl.[4] ..... H01C 7/10

[52] U.S. Cl. ..... 338/20; 252/518

[58] Field of Search ..... 252/517, 519; 264/61; 338/20, 21

[56] References Cited

U.S. PATENT DOCUMENTS

| | | | |
|---|---|---|---|
| 4,031,498 | 6/1977 | Hayashi et al. | 252/518 XR |
| 4,386,021 | 5/1983 | Kazuo et al. | 252/519 |
| 4,551,268 | 11/1985 | Eda et al. | 252/519 |
| 4,719,064 | 1/1988 | Nakata et al. | 264/61 |
| 4,724,416 | 2/1988 | Nakata et al. | 338/20 |
| 4,730,179 | 3/1988 | Nakata et al. | 338/20 |
| 4,736,183 | 4/1988 | Yamazaki et al. | 338/20 |

OTHER PUBLICATIONS

Japanese Patent Application Publication Nos. 59-41285 and 59-41286, 10/1984.

Japanese Patent Application Publication No. 60-4563, 2/1985.

*Primary Examiner*—Donald A. Griffin

*Attorney, Agent, or Firm*—Arnold, White & Durkee

[57] ABSTRACT

A voltage non-linear resistor having a voltage non-linear resistance element consisting mainly of zinc oxides and a high resistance layer including a zinc silicate phase consisting mainly of $Zn_2SiO_4$ and a spinel phase consisting mainly of $Zn_7Sb_2O_{12}$ has a continuous zinc silicate phase in which zinc silicate particles are arranged continuously. Therefore, in the voltage non-linear resistor according to the invention, a flashover can be preferably prevented, and thus a stable electric characteristics especially lightning discharge current withstanding capability can be obtained.

4 Claims, 1 Drawing Sheet

VOLTAGE NON-LINEAR RESISTOR

BACKGROUND OF THE INVENTION

1. Field of the Invention

The present invention relates to a voltage non-linear resistor comprising, as its main ingredient, zinc oxides and more particularly a voltage non-linear resistor which has stable electric characteristics such as a lightning discharge current withstanding capability.

2. Description of the Prior Art

A voltage non-linear resistor comprising zinc oxides as its main ingredient and a little amount of $Bi_2O_3$, $Sb_2O_3$, $SiO_2$, $Co_2O_3$, $MnO_2$ etc. as its additive ingredient has been heretofore known as showing an excellent voltage non-linearity. Therefore, the voltage non-linear resistor is widely utilized in arrestors etc.

Since the voltage non-linear resistor have characteristics of acting as an insulator usually but as a conductor when an overcurrent flows, a line accident due to a thunderbolt can be effectively prevented even when the thunderbolt strikes the arrestor utilizing the voltage non-linear resistor.

In a voltage non-linear resistance element of the voltage non-linear resistor mentioned above, when a surge current such as thunderbolts etc. is applied to the element, a lightning discharge mainly along a peripheral side surface of the element i.e. flashover occurs and the resistor is liable to be broken. Therefore, it is necessary to arrange a high resistance layer onto a peripheral side surface of the element. However, the flashover can not be effectively prevented corresponding to a structural state of the high resistance layer even though the high resistance layer is arranged, because the occurrence of flashover is largely dependent upon the structural state of the high resistance layer. That is to say, in the high resistance layer comprising a zinc silicate phase consisting mainly of $Zn_2SiO_4$ and a spinel phase consisting mainly of $Zn_7Sb_2O_{12}$, particle states of respective phases especially zinc silicate phase is largely dependent upon the prevention of flashover, so that, as the case may be, the flashover can not be effectively prevented.

SUMMARY OF THE INVENTION

The object of the present invention is to eliminate the drawbacks mentioned above and to provide a voltage non-linear resistor which has stable electric characteristics especially an excellent lightning discharge current withstanding capability.

According to the invention, a voltage non-linear resistor having a voltage non-linear resistance element consisting mainly of zinc oxides, and a high resistance layer provided on a peripheral side surface of said voltage non-linear resistance element, including a zinc silicate phase consisting mainly of $Zn_2SiO_4$ and a spinel phase consisting mainly of $Zn_7Sb_2O_{12}$, comprises continuous zinc silicate particles in said zinc silicate phase to form a continuous zinc silicate phase.

In the structure mentioned above, if zinc silicate particles are continuous in the zinc silicate phase constituting the high resistance layer, the resistivity of the high resistance layer becomes better as compared with the high resistance layer having discontinuous zinc silicate particles, and thus the flashover can be effectively prevented. Therefore, according to the invention, it is possible to obtain the voltage non-linear resistor which has excellent electric characteristics especially an excellent lightning discharge current withstanding capability.

DESCRIPTION OF THE PREFERRED EMBODIMENTS

Figure 1A:
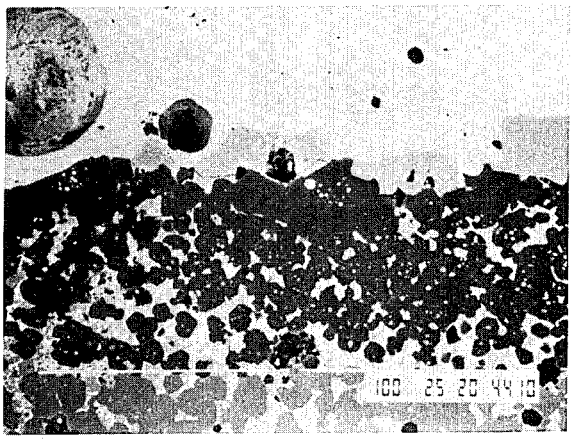
FIG. 1*a* and FIG. 1*b* sectional views (Scanning Electron Microscope Images) showing particle structures of the voltage non-linear resistor according to the present invention and the conventional one, respectively.

In order to obtain a voltage non-linear resistor comprising zinc oxides as a main ingredient, a zinc oxides material having a particle size adjusted as predetermined is mixed, for 50 hours in a ball mill, with a predetermined amount of an additive comprising respective oxides of Bi, Co, Mn, Sb, Cr, Si, Ni, Al, B, Ag, etc. having a particle size adjusted as predetermined. The thus prepared starting powder is added with a predetermined amount of polyvinylalcohol aqueous solution as a binder and, after granulation, formed into a predetermined shape, preferably a disc, under a forming pressure of 800~1,000 kg/cm$^2$. The formed body is provisionally calcined under conditions of heating and cooling rates of 50°~70° C./hr. and a retention time at 800°~1,000° C. of 1~5 hours, to expel and remove the binder.

Next, the insulating covering layer is formed on the peripheral side surface of the provisional calcined disc-like body. In the present invention, an oxide paste comprising bismuth oxides, antimony oxides, zinc oxides and silicon oxides etc. admixed with ethylcellulose, butyl carbitol, n-butylacetate or the like as an organic binder, is applied to form layers 60~300 μm thick on the peripheral side surface of the provisional calcined disc-like body. Then, this is subjected to a main sintering under conditions of heating and cooling rate of 40°~60° C./hr. and a retention time at 1,000°~1,300° C., preferably at 1,100°~1,250° C., of 3~7 hours, and a voltage non-linear resistor comprising a disc-like element and an insulating covering layer with a thickness of about 30~100 μm is obtained.

Besides, it is preferred that a glass paste comprising glass powder admixed with ethylcellulose, butyl carbitol, n-butylacetate or the like as an organic binder, is applied with a thickness of 100~300 μm onto the aforementioned insulating covering layer and then heat-treated in air under conditions of heating and cooling rates of 100°~200° C./hr. and a temperature retention time at 400°~600° C. of 0.5~2 hours, to superimpose a glassy layer with a thickness of about 50~100 μm.

The lastly, both the top and bottom flat surfaces of the disc-like voltage non-linear resistor are polished to smooth by means of SiC, $Al_2O_3$ or diamonds and provided with aluminum electrodes by means of metallizing.

In this case, the voltage non-linear resistor having a suitable high resistance layer with a continuous zinc silicate phase can be obtained by suitably combining various factors such as oxide paste compositions, methods of applying the oxide paste and sintering conditions.

That is to say, it is preferable to use the oxide paste comprising the mixture for insulating covering layer including 50~95 mol % silicon compounds calculated as $SiO_2$, 1~10 mol % bismuth compounds calculated as $Bi_2O_3$ and less than 30 mol % antimony compounds calculated as $Sb_2O_3$, and the organic binder such as ethylcellulose, buthyl carbitol, n-buthylacetate or the like, whose weight ratio is 1 (amount of mixture for insulating covering layer): 1~3 (amount of organic binder). In this case, as for the composition of the mixture for insulating covering layer other than silicon compounds, bismuth compounds and antimony compounds, use may be made of zinc compounds or the like which can be changed into oxides under 1,000° C. preferably under 800° C. That is to say, use may be made of carbonates, nitrates, hydroxides or the like, but it is preferable to use oxides. In this case, as for silicon oxides, it is most preferable to use amorphous silicon oxides. Moreover, as for the composition of the mixture for insulating covering layer, it is preferable to use $SiO_2$-$Sb_2O_3$-$Bi_2O_3$ system or $SiO_2$-$Sb_2O_3$-$Bi_2O_3$-ZnO system.

Further, as for the method of applying oxide paste, use is made of the method wherein the above oxide paste is applied on the peripheral side surface of the provisional calcined body at a plurality of times to form layers of 60~300 μm thick, by means of a dipping method or the methods utilizing roller or brush. In this case, it is preferable to effect the vacuum degassing operation for the oxide paste under 200 mmHg to eliminate pores in the oxide paste.

Moreover, it is preferable to sinter the calcined body with oxide paste layer under conditions of heating and cooling rates of 40°~60° C./hr. and a retention time at 1,000°~1,300° C., preferably at 1,100°~1,250° C. of 3~7 hours.

With respect to voltage non-linear resistors prepared with compositions respectively inside and outside the scope of the invention, results of measurement on various characteristics will be explained hereinafter.

In examples, silicon oxides, zinc oxides, bismuth oxides and antimony oxides are contained as an oxide paste and, needless to say, an equivalent effect will be realized with carbonates, hydroxides, etc. which can be converted to oxides during the firing. Also it is needless to say that, other than silicon, zinc, antimony and bismuth compounds, any materials not to impair effects of these compounds may be added to the paste in accordance with the purpose of use of the voltage non-linear resistor. On the other hand, with respect to the composition of the element also the same can be said.

EXAMPLE 1

Specimens of disc-like voltage non-linear resistors of 47 mm in diameter and 20 mm in thickness were prepared in accordance with the above-described process under the conditions of the following table 1, which had continuous or discontinuous zinc silicate phase, either inside or outside the scope of the invention, as shown in Table 1 below. With respect to each specimen, a lightning discharge current withstanding capability was evaluated. Moreover, in this example, other than the continuity of the zinc silicate phase, whether or not a mixture layer of zinc silicate and spinel arranged between the zinc silicate phase and the element is existent and whether or not the spinel phase arranged on the zinc silicate phase is continuous are observed. Further, the lightning discharge current withstanding capability means withstandability against impulse current having a waveform of 4×10 μs under various currents such as 100 KA, 120 KA, 140 KA, and the mark ○ denotes no flashover occurred upon twice applications and the mark x denotes flashover occurred. In the above embodiments according to the invention, use is made of amorphous $SiO_2$. The result is shown in Table 1.

TABLE 1(a)

| Composition of oxide paste | | | | | | | | | | |
|---|---|---|---|---|---|---|---|---|---|---|
| | Composition of mixture for insulating covering layer (mol %) | | | | | Method of applying oxide paste | | | Sintering conditions | |
| Specimen No. | $SiO_2$ | $Bi_2O_3$ | $Sb_2O_3$ | ZnO | Organic binder | Vacuum degassing | Applying times | thickness (μm) | heating and cooling rate (°C./hr) | maximum temperature × retention time (°C. × hr) |
| Present invention | | | | | | | | | | |
| 1 | 87 | 3 | 10 | — | (weight ratio) 1:2 | effect | 3 | 250 | 40 | 1200 × 5 |
| 2 | 55 | 2 | 6 | 37 | (weight ratio) 1:2 | effect | 2 | 200 | 50 | 1150 × 5 |
| 3 | 72 | 8 | 20 | — | (weight ratio) 1:2 | effect | 3 | 220 | 40 | 1180 × 5 |
| 4 | 62 | 10 | 28 | — | (weight ratio) 1:3 | no-effect | 2 | 180 | 50 | 1200 × 5 |
| 5 | 95 | 2 | 3 | — | (weight ratio) 1:1 | no-effect | 2 | 250 | 60 | 1180 × 5 |
| Comparison | | | | | | | | | | |
| 1 | 83 | 6 | 11 | — | (weight ratio) 1:0.5 | no-effect | 1 | 200 | 100 | 1200 × 5 |
| 2 | 46 | 16 | 38 | — | (weight ratio) 1:4 | no-effect | 3 | 190 | 80 | 1200 × 5 |

TABLE 1(b)

| Specimen No. | Zinc silicate phase | Zinc silicate + Spinel | Spinel phase | Lightning discharge current withstanding capability | | |
|---|---|---|---|---|---|---|
| | | | | 100 KA | 120 KA | 140 KA |
| Present invention | | | | | | |
| 1 | continuous | existent | discontinuous | O | O | O |
| 2 | continuous | existent | discontinuous | O | O | O |
| 3 | continuous | existent | discontinuous | O | O | O |
| 4 | continuous | existent | continuous | O | O | X |
| 5 | continuous | substantially | discontinuous | O | O | X |

TABLE 1(b)-continued

| Specimen No. | Zinc silicate phase | Zinc silicate + Spinel | Spinel phase | Lightning discharge current withstanding capability 100 KA | 120 KA | 140 KA |
|---|---|---|---|---|---|---|
| | | non-existent | | | | |
| Comparison | | | | | | |
| 1 | discontinuous | existent | discontinuous | X | | |
| 2 | discontinuous | existent | discontinuous | X | | |

As is clear from the result shown in Table 1, the specimens of Nos. 1 to 5 according to the invention each having the continuous zinc silicate phase are good and stable in the lightning discharge current withstanding capability as compared with the comparison specimens of Nos. 1 and 2.

Figure 1B:
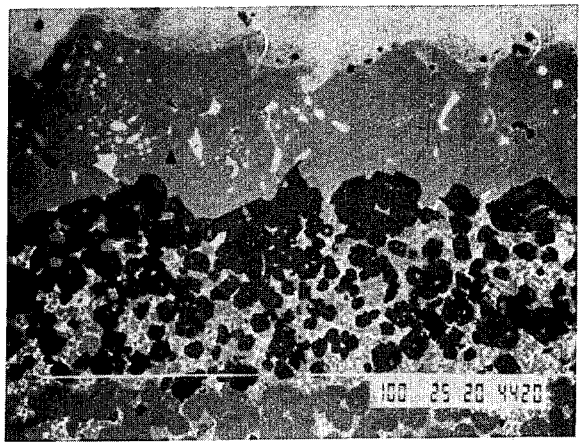

FIG. 1*a* and FIG. 1*b* are cross sectional views showing particle structures of the voltage non-linear resistor according to the present invention and the conventional one, respectively. In the embodiment according to the invention shown in FIG. 1*a*, the continuous zinc silicate phase of dark gray having a thickness of about 60~70 μm is located substantially at a center of FIG. 1*a*. Moreover, the mixture layer composed of the zinc silicate of dark gray and the spinel of light gray is located between the continuous zinc silicate phase and the element. Further, the spinel phase of light gray is located on the continuous zinc silicate phase. Contrary to this, in the embodiment according to the conventional one shown in FIG. 1*b*, the zinc silicate phase of dark gray located at a center of FIG. 1B is discontinuous, and the bismuth oxide phase of white and the spinel phase of light gray are existent in the discontinuous portion of the zinc silicate phase.

Moreover, in the embodiment according to the invention, it is preferable, for the increase of the cohering strength between the resistance element and the high resistance layer and the insulating characteristics, that a thickness of the continuous zinc silicate phase is set within a range of 20~100 μm and an average particle size of zinc silicate is set within a range of 5~40 μm. Further, it is preferable that a thickness of the mixture layer of zinc silicate and spinel located between the continuous zinc silicate phase and the resistance element is set within a range of 5~70 μm and average particle sizes of zinc silicate and spinel are set within a range of 1~10 μm, respectively. Furthermore, it is preferable that the spinel phase located on the continuous zinc silicate phase is discontinuous and an average particle size of spinel is set within a range of 10~30 μm.

As is clear from the descriptions mentioned above, according to the invention, since the zinc silicate phase is formed continuously in the high resistance layer, the flashover can be effectively prevented, so that the stable electric characteristics especially the lightning discharge current withstanding capacity can be obtained.

Furthermore, according to the invention, good life performances and good surge characteristics such as switching surge etc. can be obtained.

What is claimed is:

1. A voltage non-linear resistor having a voltage non-linear resistance element consisting mainly of zinc oxides, and a high resistance layer provided on a peripheral side surface of said voltage non-linear resistance element, including a zinc silicate phase consisting mainly of $Zn_2SiO_4$ and a spinel phase consisting mainly of $Zn_7Sb_2O_{12}$, compring continuous zinc silicate particles in said zinc silicate phase to form a continuous zinc silicate phase.

2. A voltage non-linear resistor according to claim 1, wherein a thickness of said continuous zinc silicate phase is set within a range of 20~100 μm and an average particle size of zinc silicate particles is set within a range of 5~40 μm.

3. A voltage non-linear resistor according to claim 1, wherein a mixture layer of zinc silicate and spinel having a thickness of 5~70 μm is existent between said continuous zinc silicate phase and said resistance element, and average particle sizes of zinc silicate and spinel are set within a range of 1~10 μm, respectively.

4. A voltage non-linear resistor according to claim 1, wherein said spinel phase located on said continuous zinc silicate phase is discontinuous and an average particle size of spinel is set within a range of 10~30 μm.

* * * * *